United States Patent [19]

Simon et al.

[11] Patent Number: 4,494,658

[45] Date of Patent: Jan. 22, 1985

[54] MODULAR DISPLAY FOR CIGARETTE PACKS

[75] Inventors: Virgil S. Simon, Glenview; Marvin L. Adenau, Hoffman Estates; John S. Skalski, Hanover Park, all of Ill.

[73] Assignee: Thomas A. Schutz Co., Inc., Morton Grove, Ill.

[21] Appl. No.: 514,346

[22] Filed: Jul. 15, 1983

[51] Int. Cl.[3] ..... A47F 7/00

[52] U.S. Cl. ..... 211/49 R; 40/10 R; 40/489; 206/558; 211/126

[58] Field of Search ..... 211/49 R, 490, 133, 211/126, 11, 88; 40/10 R, 606, 607, 611, 124, 489, 490, 491; 206/558

[56] References Cited

U.S. PATENT DOCUMENTS

| | | | |
|---|---|---|---|
| 3,132,431 | 5/1964 | Petrie | 40/611 |
| 3,463,524 | 8/1969 | Saxe . | |
| 3,851,435 | 12/1974 | Roberts et al. . | |
| 4,148,454 | 4/1979 | Carlson et al. . | |
| 4,356,646 | 11/1982 | Johnson | 40/10 R X |
| 4,429,796 | 2/1984 | Sussman | 211/11 |
| 4,438,852 | 3/1984 | Evans | 211/11 |

*Primary Examiner*—Robert W. Gibson, Jr.

*Attorney, Agent, or Firm*—Wood, Dalton, Phillips, Mason & Rowe

[57] ABSTRACT

A modular display device for articles of merchandise which are sold at retail in small packages includes a display tray, an advertising sign frame adapted to receive and hold an advertising sign, a support member to which the advertising sign frame is detachably connected by resilient tongues on the frame which interengage with slots in a front wall of the support member, and a laterally extending web which is an extension of a bottom wall of the support member that enters a laterally open slideway on a bottom wall of the tray adjacent a tray end wall and has a hooked finger engaging a recess in the slideway so the advertising sign frame is immediately adjacent said tray end wall.

16 Claims, 7 Drawing Figures

MODULAR DISPLAY FOR CIGARETTE PACKS

BACKGROUND OF THE INVENTION

Companies that produce merchandise which is displayed and sold in small packages, such as cigarettes, chewing gum, candy bars and the like, are always interested in compact, attractive display apparatus which will accommodate their merchandise and an advertising message on a retail store counter or display shelf. A very popular location for such apparatus is at a check-out counter of a supermarket, chain drug store or the like.

In certain retail store locations, vertical space limitations require that a display tray and advertising message be located side-by-side, rather than one above the other. The apparatus needs to be of a type which may be shipped knocked down and easily assembled in a retail store.

SUMMARY OF THE INVENTION

The present apparatus consists of a modular display for either 15 or 30 packages of cigarettes, but it is quite apparent that the structure could be adapted to various other kinds of merchandise merely by changing the dimensions of the trays in which the merchandise is displayed.

Two identical trays are adapted to be joined together in end abutting relationship, or one tray may be used singly. In either case the display tray or trays may stand upon a planar surface with a support member for an advertising sign frame detachably connected to either end of the tray or trays, and with an advertising sign frame detachably connected to the support member. The connection between the support member and a tray is by resiliently interengaging components at an end wall of the tray and at a side of the support member; while the detachable connection between the advertising sign frame and the support member is by resiliently interengaging elements on a front wall of the support member and on the back of the advertising sign frame.

The bottoms of the trays are provided with pads of pressure sensitive adhesive so they may be adhered to a surface upon which they are supported, thereby eliminating the possibility of inadvertently knocking the display off a counter or shelf.

THE DRAWINGS

DETAILED DESCRIPTION OF THE INVENTION

Figures 1, 2, 3:
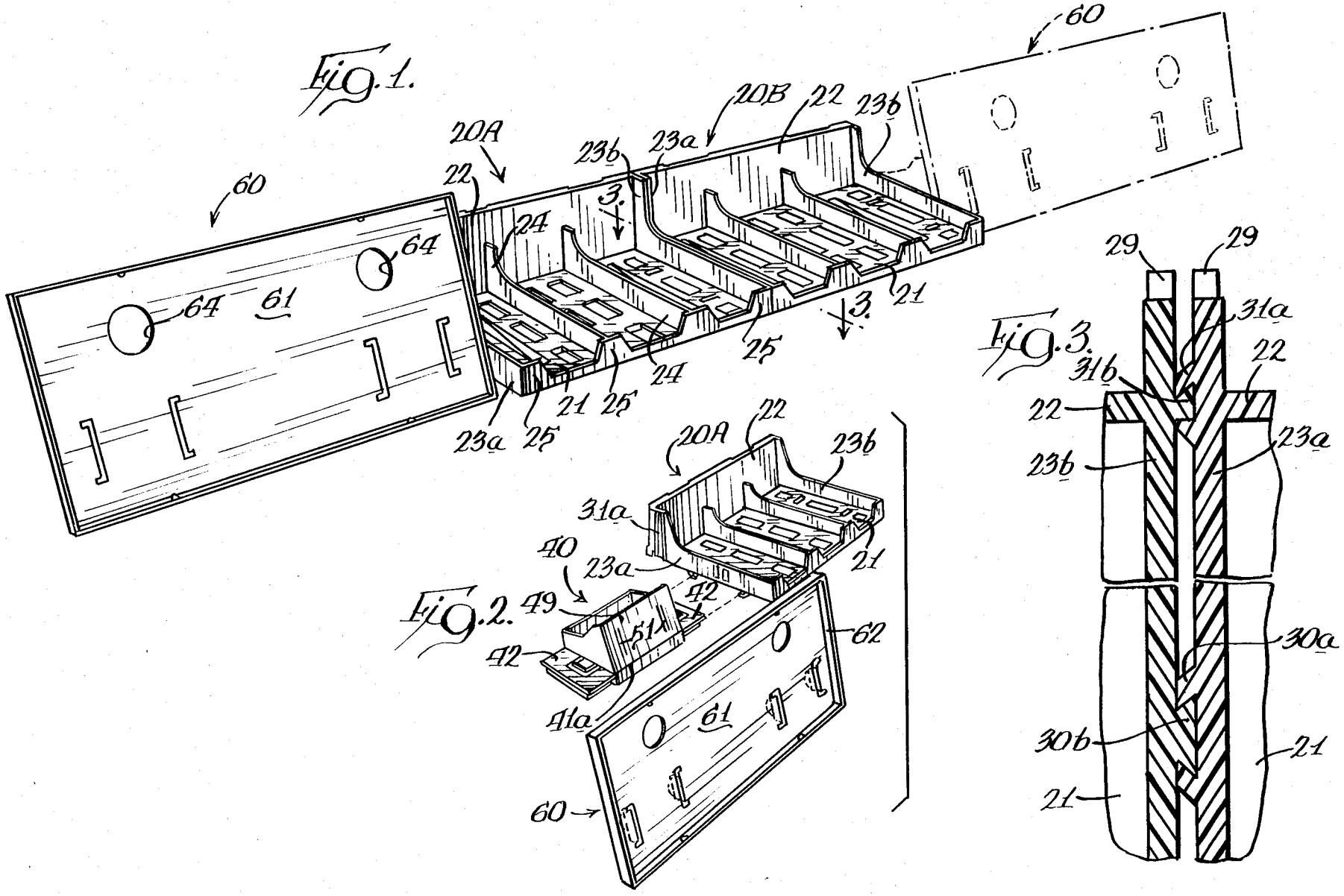
FIG. 1 is a perspective view of the apparatus of the invention with two trays connected end-to-end, a sign holder illustrated in full lines of one end of the tray assembly and in broken lines at an alternative position at the opposite end of the tray assembly.
FIG. 2 is an exploded view of one of the two trays, the support member and the advertising sign frame.
FIG. 3 is a fragmentary sectional view on an enlarged scale taken substantially as indicated along the line 3—3 of FIG. 1.

Referring to the drawings in detail, the apparatus consists generally of two identical molded plastic trays, indicated generally at 20A and 20B; a sign frame support member, indicated generally at 40; and a sign frame, indicated generally at 60. Each of the above-identified components consists of a one-piece plastic molding.

Each of the two identical trays 20A and 20B consists of a lattice-like bottom wall 21, a rear wall 22, end walls **23*a* and 23*b*, partitions 24 parallel to the end walls, and front flanges 25 which extend transversely inwardly from the end walls 23 and transversely to both sides of the partitions 24**.

Figure 5:
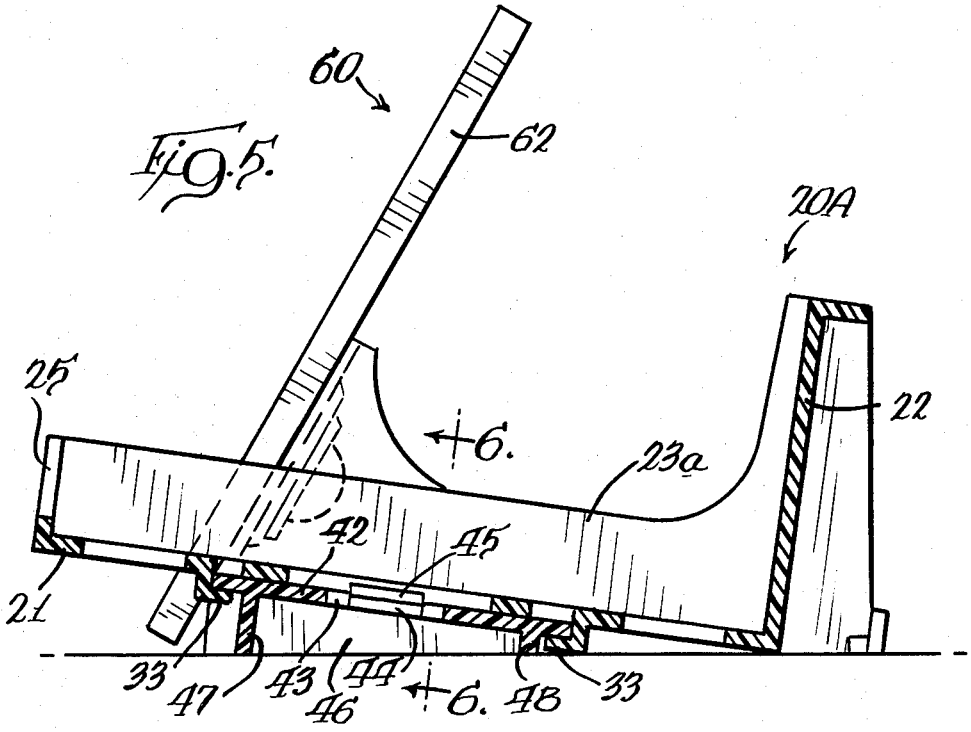
FIG. 5 is a fragmentary sectional view taken substantially as indicated along the line 5—5 of FIG. 4.

Each tray has a base consisting of a pair of fore-and-aft extending base rails 26 which are adapted to rest stably upon a horizontal surface, and which are provided with pressure-sensitive adhesive pads **26*a* toward the front and 26*b* toward the rear. The base rails 26 are best seen in FIG. 5 to be deeper at the front than at the rear, so the bottom wall 21** of the tray is inclined rearwardly when the tray is supported upon a horizontal surface.

Integral with the rear wall 22 are a rearwardly extending rear ledge 27 and cantilever mounting components 28 and 29 for supporting the tray upon a pole mounting as taught in applicants' copending application titled "Modular Display for Cigarette Packs", filed July 1, 1983 as Ser. No. 510,436.

In order that the trays 20A and 20B may be fixedly joined together with the end wall **23*a* of the tray 20A abutting the end wall 23*b* of the tray 20B, each of the end walls 23*a* is provided with a forward female dovetail connection 30*a* and a rearward female dovetail connection 31*a*, and each of the end walls 23*b* is provided with a forward male dovetail connection 30*b* and a rearward female dovetail connection 31*b***, said dovetail connections interfitting to fixedly join the trays together.

The support member 40 may be secured to the tray 20A or the tray 20B either at an end wall **23*a* or at an end wall 23*b*; and this is accomplished by resiliently interengaging components, indicated generally at 32, which are at each end wall of each tray and at each side of the support member 40. Those portions of the interengaging component which are at the ends of the trays consist of opposed inturned flanges 33 which are offset downwardly from the bottom wall 21 of the tray immediately adjacent the end walls, and said inturned flanges define a laterally open slideway 34. Adjacent openings 35 in the tray bottom wall 21 which are adjacent the two tray end walls provide recesses in the slideway one side of each of which is defined by a shallow, upright surface 36**.

Figure 4:
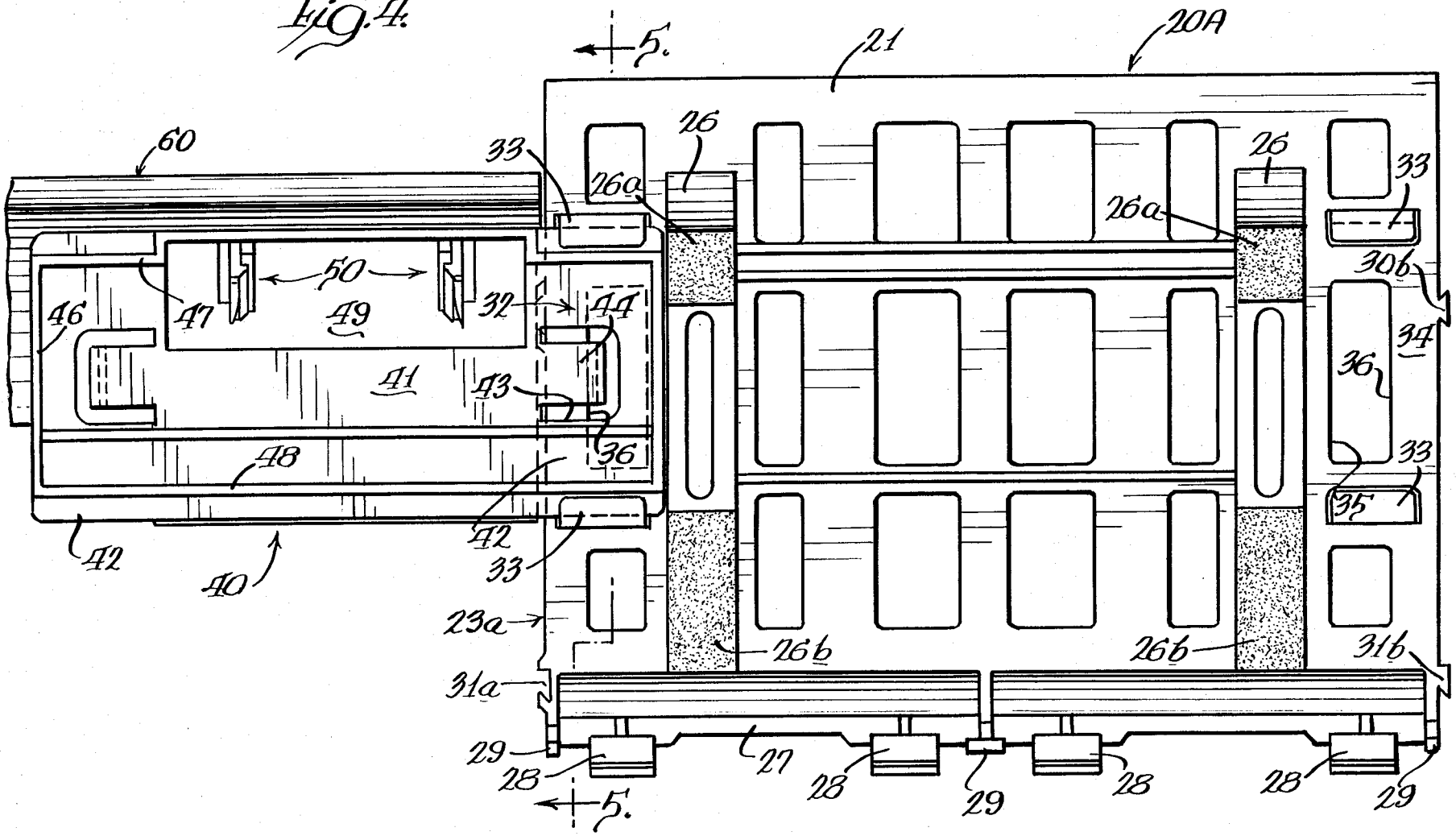
FIG. 4 is a bottom plan view of one tray with the support member/connected thereto and the advertising sign frame mounted upon the support member.
Figure 6:
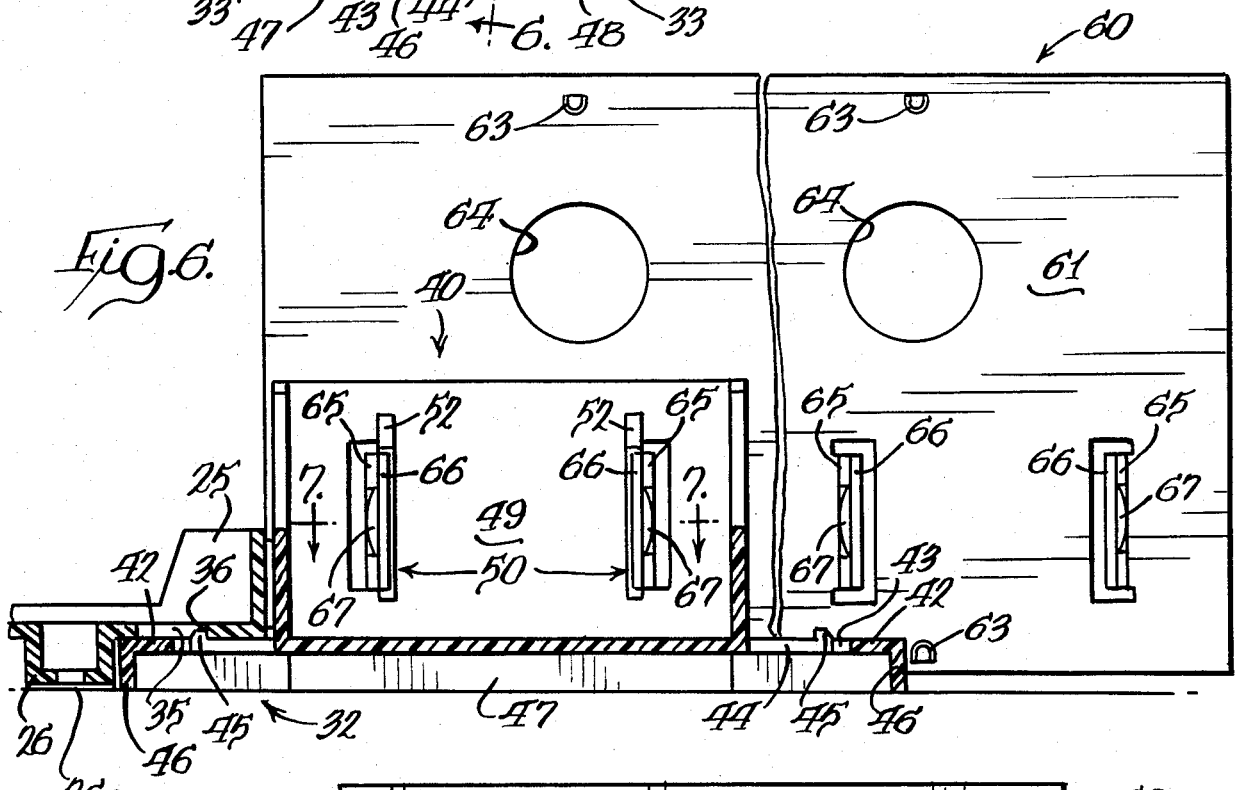
FIG. 6 is a fragmentary sectional view taken substantially as indicated along the line 6—6 of FIG. 5.
Figure 7:
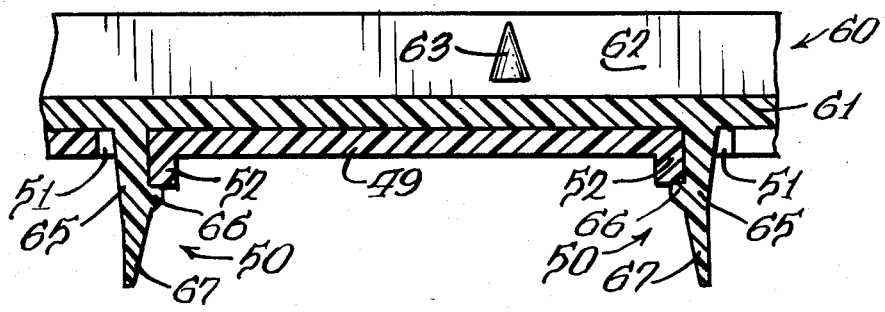
FIG. 7 is a fragmentary sectional view taken substantially as indicated along the line 7—7 of FIG. 6.

The support member 40 is best seen in FIGS. 2 and 4 to have a bottom wall 41 with extensions 42 at its two ends defining laterally projecting webs which are parts of the resiliently interengaging components 32; and in each of the webs 42 is an opening 43 in which there is a resilient finger 44 that has an upturned hook 45 at its outer end which is also one of the resiliently interengaging components 32. When the support member 40 is secured to a tray 20A or 20B, one of the two webs 42 extends into the slideway 34, and one of the hooks 45 engages behind one of the shallow upright surfaces 36, as best seen in FIGS. 5 and 6.

Surrounding the entire bottom wall 41 of the support member 40, including the extensions 42, is a shallow skirt that includes side webs 46 one of which substantially abuts a tray base rail 26 when the support member is secured to the tray. The skirt also includes a front web 47 and a rear web 48 which is considerably shallower than the web 47.

Along a front margin 41*a* of the support member bottom wall 41, at the upper margin of the web 47, is a front wall 49 of the support member which occupies a rearwardly inclined position above the bottom wall 41 and has a lower edge integral with said front margin 41*a*.

The support member 40 and the advertising sign frame 60 are detachably secured to one another by resiliently interengaging elements, indicated generally at 50. The resiliently interengaging elements 50 include parallel upright slots 51 in the support member front wall 49, and on the rear of the wall 49 along the inner margins of the slots are ribs 52.

The sign frame 60 consists of a rectangular sign frame body plate 61 which is surrounded by a rim 62, and on the rim at the top and bottom of the sign frame 60 are small, inwardly extending nibs 63 behind which an advertising sign of resilient material such as cardboard may be mounted. Finger holes 64 in the body plate facilitate removal of an advertising sign from the sign frame.

On the rear of the sign frame, adjacent each end of the body plate 61, is a pair of resilient spring tongues 65 which have inturned hooks 66 that engage behind the ribs 52, so that said spring tongues 65 and hooks 66 form the other elements of the resiliently interengaging elements 50. At the extremity of each of the spring tongues 65 is a finger piece 67 which facilitates engagement and disengagement of the hooks 66 with the ribs 52.

The location of each of the pairs of resilient tongues 65 with respect to the ends of the sign frame 60 is such that, when the sign frame is mounted upon the support member 40 and the support member is secured to a tray, an end of the sign frame is substantially in contact with a tray side wall 23*a* or 23*b*, as the case may be.

It is apparent from the foregoing detailed description that the advertising sign frame 60, when appropriately mounted upon the support member 40, may be positioned at either end of a tray 20A or 20B, or at either end of a pair of such trays which are connected together as seen in FIG. 1.

The foregoing detailed description is given for clearness of understanding only and no unnecessary limitations should be understood therefrom, as modifications will be obvious to those skilled in the art.

We claim:

1. A modular display apparatus for merchandise which is displayed and sold in small packages, said apparatus comprising, in combination:

display tray means adapted to hold a plurality of packages of merchandise, said display tray means having a bottom wall, end walls and a rear wall;

means for fixing said tray means at a desired location in a retail shop;

an advertising sign frame adapted to receive and hold an advertising sign;

a support member for said advertising sign frame;

resiliently interengaging elements on said support member and on said advertising sign frame for detachably securing the advertising sign frame to the support member;

and resiliently interengaging components at an end wall of said tray means and at a side of said support member for detachably securing said support member to said tray means with the advertising sign frame immediately adjacent to said end wall of said tray means.

2. The combination of claim 1 in which the support member has a front wall, the advertising sign frame has a planar body a portion of which is adapted to occupy a position forward of and parallel to said front wall, and the resiliently interengaging elements are on said front wall and on said portion of said planar body.

3. The combination of claim 2 in which the resiliently interengaging elements comprise slots in said front wall and rearwardly extending resilient tongues on said portion of the planar body which engage in said slots.

4. The combination of claim 3 in which the tongues are laterally spaced and have hooks which snap behind margins of said slots.

5. The combination of claim 4 in which there are shallow, rearwardly extending ribs on the back of said front wall along said margins of said slots, and said hooks engage the rear of said ribs.

6. The combination of claim 5 in which the support member has a bottom wall, and a lower edge of said front wall is integral with the front margin of said bottom wall, and said front wall occupies a rearwardly inclined position above said bottom wall.

7. The combination of claim 6 in which the resiliently interengaging components comprise opposed inturned flanges defining a laterally open slideway on the bottom wall of the tray means adjacent said end wall, and a laterally projecting web generally in the plane of the bottom wall of the support member at said side of the support member, said web slidably engaging in said slideway.

8. The combination of claim 7 in which the bottom wall of the tray has a recess in said slideway and the web has a hook which engages in said recess.

9. The combination of claim 8 in which the web comprises an extension of the bottom wall of the support member, and a resilient finger in an opening in the web is coplanar with the web and has the hook at its outer end.

10. The combination of claim 1 in which the support member has a bottom wall, and the resiliently interengaging components comprise opposed inturned flanges defining a laterally open slideway on the bottom wall of the tray means adjacent said end wall, and a laterally projecting web generally coplanar with the bottom wall of the support member at said side of the support member, said web slidably engaging in said slideway.

11. The combination of claim 10 in which the bottom wall of the tray has a recess in said slideway and the web has a hook which engages in said recess.

12. The combination of claim 11 in which the web comprises an extension of the bottom wall of the support member, and a resilient finger in an opening in the web is coplanar with the web and has the hook at its outer end.

13. The combination of claim 12 in which the support member has a front wall, the advertising sign frame has a planar body a portion of which is adapted to occupy a position forward of and parallel to said front wall, and the resiliently interengaging elements are on said front wall and on said portion of said planar body.

14. The combination of claim 13 in which the resiliently interengaging elements comprise slots in said front wall and rearwardly extending resilient tongues on said portion of the planar body which engage in said slots.

15. The combination of claim 14 in which the front wall of the support member has a lower edge which is integral with a front margin of the support member bottom wall, and said front wall occupies a rearwardly inclined position above said bottom wall.

16. The combination of claim 1 which includes resiliently interengaging components at both end walls of said tray means and at two sides of said support member, whereby the advertising sign frame may be located immediately adjacent to either end wall of the tray means.

* * * * *